United States Patent [19]

Rose

[11] Patent Number: 4,475,362

[45] Date of Patent: Oct. 9, 1984

[54] DESIGN ARRANGEMENT FOR KNITTING MACHINES

[75] Inventor: Wolfgang Rose, Karl Marx Stadt, German Democratic Rep.

[73] Assignee: VEB Kombinat Textima, Karl Marx Stadt, German Democratic Rep.

[21] Appl. No.: 440,029

[22] Filed: Nov. 8, 1982

[30] Foreign Application Priority Data

Nov. 17, 1981 [DD] German Democratic Rep. ..... 2349117

[51] Int. Cl.[3] ..... D04B 7/00

[52] U.S. Cl. ..... 66/75.2

[58] Field of Search ..... 66/75.2, 75.1, 64, 60

[56] References Cited

U.S. PATENT DOCUMENTS

| | | | |
|---|---|---|---|
| 2,821,073 | 1/1958 | Mehnert | 66/64 |
| 3,899,899 | 8/1975 | Bartels | 66/75.2 |
| 3,974,664 | 8/1976 | Erb | 66/75.2 |
| 4,015,446 | 4/1977 | Kagaya | 66/75.2 |
| 4,292,821 | 10/1981 | Koike et al. | 66/75.2 |
| 4,302,952 | 12/1981 | Wolfgang | 66/75.2 |

*Primary Examiner*—Ronald Feldbaum
*Attorney, Agent, or Firm*—Michael J. Striker

[57] ABSTRACT

A design arrangement for a knitting machine having a needle bed with a plurality of needles includes a plurality of carriages movable along a needle bed, a design wheel arranged on each of the carriages, a plurality of plate bars arranged on each of the design wheels in correspondence with a pitch of needles for actuating the latter and movable between a plurality of selectable positions, a selector and a time signal generator arranged on each of the carriages with the selector provided with a plurality of staggered selection pieces which are electromechanically bringable into two positions and cooperate with feet of plate bars to select the latter, a movable information storage which is moved by the carriages and an immovable storage arranged to supply information to the selectors so as to actuate the latter, and an arresting disk provided with a wedge which extends over substantially half of its periphery and with a counter guide so as to arrest the plate bars upon their selection by the selection pieces and until their running over the needles.

8 Claims, 3 Drawing Figures

DESIGN ARRANGEMENT FOR KNITTING MACHINES

BACKGROUND OF THE INVENTION

The present invention relates to a design arrangement for knitting machines with a design wheel arranged on knit carriages.

The design arrangements of the above-mentioned general type are known in the art. These design arrangements can be provided for flat knitting machines with knit carriages circulating in one direction. It can also be utilized on circular knitting machines with a rotatable cam ring and respectively modified on flat knitting machines with reciprocating knitting carriage. One such design arrangement is disclosed, for example, in German Pat. No. 1,044,337. In accordance with this arrangement, prior to the working stroke of the knitting carriages, the desired design is transmitted from a jacquard card supported on a jacquard card prism, via jacquard plate bars, to design wheel plate bars arranged on a design wheel at distances corresponding to knit needle pitch. The design wheel plate bars are arrested by a disk in their selected position. During the knitting process proper, or during running of the knit carriages with the design wheel rotating over the needle beds, the feet of the design wheel plate bars selected in accordance with the design act upon knitting needles arranged springily in a design pin and press them out of the engagement region of the knit locks. The above described arrangement possesses, however, the disadvantage that it makes possible to knit only such a design which corresponds to the periphery of the design wheel and repeats over the entire needle bed width. An increase in dimensions of the design wheel is not possible because of space problems. For widening the possibilities of providing designs, several solutions are known in accordance with which the design of the double design wheel periphery or the design corresponding to the design wheel periphery can operate only at a predetermined location of the knitting. However, the design width is here also limited.

The German Democratic Republic Pat. No. 146623 discloses an electrically controlled selection arrangement for needles of flat knitting machines in which selection pushers which control the needles first has staggered feet arranged with formation of foot rows in direction of elongation of the needle bed, and a driving-out member is provided on the carriages for the same. The driving-out member is switchable in and out between the neighboring feet of one foot row. The driving-out location is formed as double-arm lever with a driving-out incline on one lever arm and a fork on the other lever arm, in which a hinged armature of an associated control magnet engages. In this construction, however, the entire needle bed and the knit carriage are designed completely different, and a transmission to machines with a design wheel is not possible.

SUMMARY OF THE INVENTION

Accordingly it is an object of the present invention to provide a design arrangement for knitting machines, which avoids the disadvantages of the prior art.

More particularly, it is an object of the present invention to provide a design arrangement for knitting machines, which allows to maintain the design of needle beds and the knit carriages and does not require a great number of complicated mechanical parts and at the same time allows with minimum structural costs to reduce expenditures for replacement of designs and to make shorter the time required therefor.

Still another feature of the present invention is to provide a design arrangement for knitting machines with a design wheel, which makes possible to considerably increase the possibilities of using different designs, and to use for respective knitting works maximum designs extending over the entire needle bed width, and so that via design wheel plate bars an individual needle selection of all knitting needles of the needle bed can be carried out.

In keeping with these objects, and with others which will become apparent hereinafter, one feature of the present invention resides, briefly stated, in a design arrangement for a knitting machine, which has a selector and a time signal generator arranged on each of movable carriages, the selector having a plurality of staggered selection pieces which are electromechanically bringable into two positions and cooperate with feet of plate bars provided on a design wheel of the respective carriage, a movable information storage which is moved by the carriages and an immovable storage arranged to supply information to the selectors so as to actuate the latter, and a wedge extending over substantially half of an arresting disk periphery and a counter guide provided for arresting the plate bars upon their selection by the selection pieces of the design wheel and until their running by the needles.

When the design arrangement is formed in accordance with the present invention, a design replacement expenses are reduced and a design conversion time is considerably decreased while the construction of the needle beds and the knit carriages is retained the same.

In accordance with another feature of the present invention, there is only movable storage provided with an associated electronic control, and a cable which connects the carriages with one another is arranged so that the information is transmitted from the one information storage with the electronic control via the cable to the selectors.

Still another feature of the invention is that there are a plurality of such movable information storages which move together with the carriages and are provided with associated electronic controls so that each movable storage transmits the information to a group of the selectors.

A further feature of the present invention is that the time signal generator is arranged on a carriage bracket of each of the carriages and a timing gear is provided on each of the design wheels and cooperates with the respective one of the time signal generators so as to provide for synchronous movement of the design wheels and actuation of the selection pieces.

Still a further feature of the present invention is that the information synchronized by time signals is supplied from the movable storage via the associated electronic control to the selectors.

In accordance with yet a further feature of the present invention, the counter guide of the arresting disk is provided at an end of the wedge with a curve for bringing the plate bars to a ready-to-be-selected position.

Finally, there are a plurality of exchangeable information carriers each containing an entire knitting program and arranged to introduce a design program into the movable information storage in an operative position of the knitting machine.

The novel features which are considered characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF A PREFERRED EMBODIMENT

Figure 1:
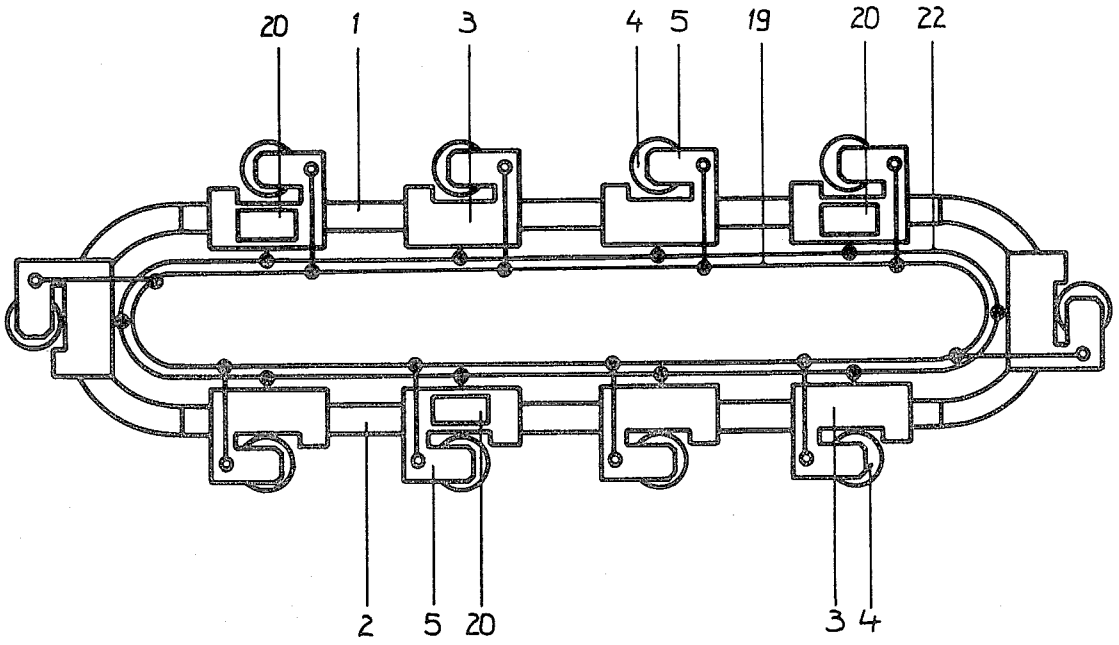
FIG. 1 is a view showing knit carriages with design wheels in a flat-circular knitting machine in accordance with the present invention.

A knitting machine in accordance with the present invention has two pairs of needle beds which are identified with reference numerals 1 and 2 in FIG. 1. A plurality of knit carriages glide over the needle beds in a continuous circulation in one direction along an oval path.

Figure 2:
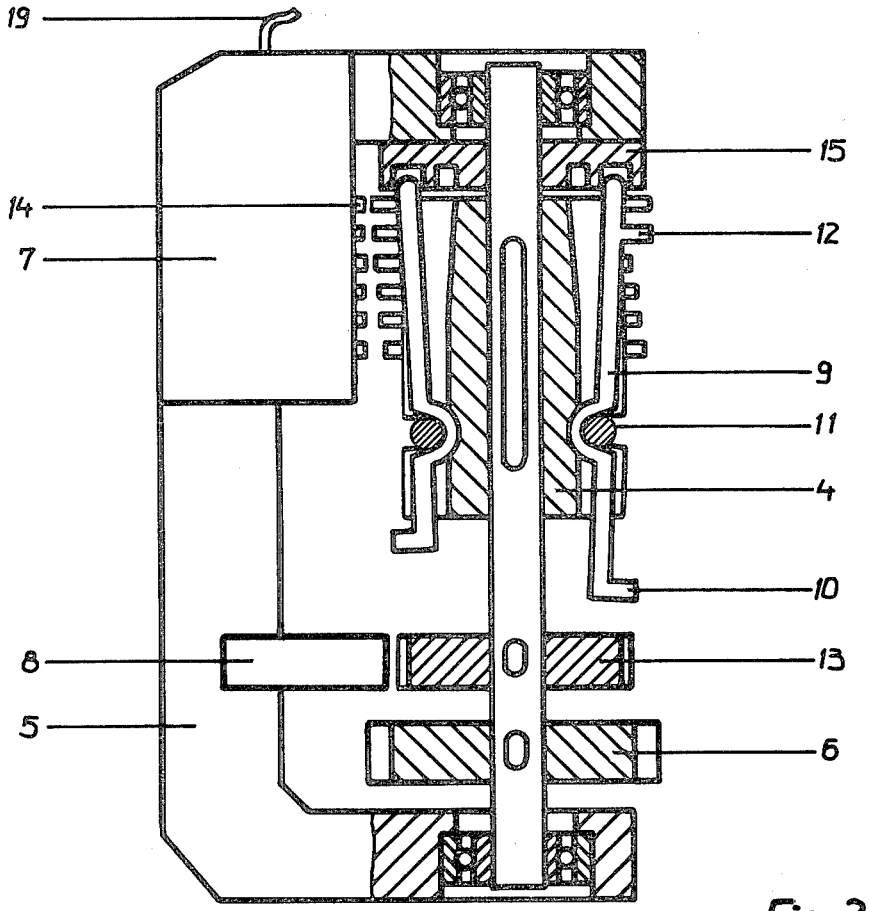
FIG. 2 is a view showing a section of one of the design wheels of the inventive knitting machine.
Figure 3:
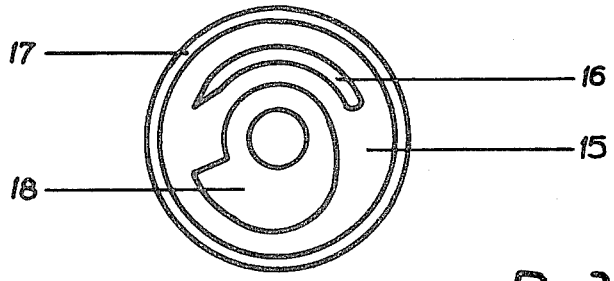
FIG. 3 is a plan view of a disk for arresting plate bars of the inventive knitting machine.

Each knit carriage 3 has, in addition to knit locks or cams, a design wheel 4 which is connected with the carriage via a design wheel bracket 5. The design wheel 4 rolls via a gear 6 shown in FIG. 2 on a not shown gear rack arranged on a needle bed carrier. The design wheel bracket 5 carries also a selector 7 and a rhythm or time signal generator 8. The body of the design wheel 4 is provided in a known manner with slots arranged in correspondence with the needle bed pitch for receiving plate bars 9.

Each plate bar 9 has a foot 10 provided at its upper end, a pivot point 11, and a foot 12 provided above the pivot point 11. The feet 12 of the laterally adjacent plate bars 9 are arranged differently to the pivot point 11 for cooperation with selection pieces 14 located in a staggered manner on the selector 7. The feet 10 act in a known manner in accordance with the design upon spring pins, and press these spring pins so as to press via these spring pins the feet of the selected needles from the engagement region of the knit locks or cams.

For arresting the plate bars 9 in their selected position, a disk 15 is provided. The disk 15 has an upper side which faces toward the ends of the plate bars and is provided at this upper side with a wedge 16 which extends over approximately half of the disk periphery and with a counter guide 17 with a curve 18. In the region of the wedge 16, the plate bars 9 are arrested for cooperation with the spring pins in their selected position. During further running of the knit carriages 3 with the rolling design wheel 4, they are again brought by the curve 18 to selection readiness, are again selected via the selection pieces 14, and after this arrested by the wedge 16. This cycle repeats continuously.

In the selection region, the feet 12 act upon the selection pieces 14 of the selector 7 and are pressed back by the latter in accordance with the design to the center of the design wheel or remain in their position. The selection pieces are bringable electromechanically in dependence upon the desired design into two positions. A cable 19 moves together and connects the knit carriages 3 with one another. The informations for displacement of the selection pieces 14 in accordance with the design arrives via the cable 19 from one or more storages 20 with associated electronic control. Each knitting machine can be provided with only one storage 20, which transmits the informations to the selectors 7 of the individual knit carriages 3, or with several storages 20 each of which supplies only a predetermined number of the selectors 7 with informations.

For providing a synchronous movement of the design wheel 4 and the selector actuation or actuation of the selection pieces 14, a timing gear 13 is arranged on the design wheel 4 and cooperates with the time signal generator 8 located on the design wheel bracket 5. Synchronizedby the time signal, the design informations are supplied via an electronic control from one or several storages 20 to the selectors 7. The current supply of the electronic control, the storage 20 to the selectors 7 is performed via a sliding contacts from a bus bar 22.

The design informations are transmitted from a stationary design storage to one or several storages 20 running together with the knit carriages 3. This transmission is performed either prior to the start of the knitting machine for the entire knitting, or continuously at least for one carriage circulation. With the not working knitting machine, the design transfer can be carried out with the aid of exchangeable information carrier, for example cassettes or magnetic disks, and in running knitting machine with the aid of optoelectronic signals. The introduction of the design program with the aid of exchangeable information carriers has the considerable advantage that no special transmission elements and no special storages are required outside of the circulating knit carriages. The design arrangement is thereby very simple.

It will be understood that each of the elements described above, or two or more together, may also find a useful application in other types of constructions differing from the types described above.

While the invention has been illustrated and described as embodied in a design arrangement for knitting machines, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

I claim:

1. A design arrangement for a knitting machine having a needle bed with a plurality of needles arranged with a predetermined pitch, the design arrangement comprising a plurality of carriages movable along a needle bed;

a design wheel arranged on each of said carriages;

a plurality of plate bars arranged on each of said design wheels in correspondence with a pitch of needles for actuating the latter and movable between a plurality of selectable positions, each of said plate bars having a foot;

a selector and a time signal generator arranged on each of said carriages, said selector having a plurality of staggered selection pieces which are electromechanically bringable in two positions and cooperate with said feet of said plate bars to select the latter;

a movable information storage which is moved by said carriages and an immovable storage arranged to supply information to said selectors so as to actuate the latter; and a disk having a side facing toward said plate bars and provided at said side with arresting formations arranged to arrest said plate bars upon their selection by said selection pieces and until their running over the needles, said arresting formations including a wedge extending over substantially half of a disk periperhy and a counter guide.

2. A design arrangement as defined in claim 1, wherein the arrangement comprises only one said movable storage provided with an associated electronic control; and further comprising a cable connecting said carriages with one another and arranged so that the information is transmitted from said one information storage with said electronic control via said cable to said selectors.

3. A design arrangement as defined in claim 1, wherein the arrangement has a plurality of such movable information storages which move together with said carriages and are provided with associated electronic controls, so that each of said movable storages transmit the information to a group of said selectors.

4. A design arrangement as defined in claim 1, wherein each of said carriages has a carriage bracket carrying said time signal generator; and further comprising a timing gear arranged of each of said design wheels and cooperating with a respective one of said time signal generators to provide synchronous movement of said design wheel and actuation of said selection pieces.

5. A design arrangement as defined in claim 4, wherein said movable information storage has an associated electronic control arranged so that the information synchronized by time signals is supplied from said movable storage via said associated electronic control to said selectors.

6. A design arrangement as defined in claim 1, wherein said counter guide of said disk is provided at an end of said wedge with a curve for bringing said plate bars to a ready-to-be-selected position.

7. A design arrangement as defined in claim 1; and further comprising a plurality of exchangeable information carriers each containing an entire knitting program and arranged to introduce a design program into said movable information storage in inoperative position of the knitting machine.

8. A design arrangement for a knitting machine having a needle bed with a plurality of needles arranged with a predetermined pitch, the design arrangement comprising a plurality of carriages movable along a needle bed;

a design wheel arranged on each of said carriages;

a plurality of plate bars arranged on each of said design wheels in correspondence with a pitch of needles for actuating the latter and movable between a plurality of selectable positions, each of said plate bars having a foot;

a selector and a time signal generator arranged on each of said carriages, said selector having a plurality of staggered selection pieces which are electromechanically bringable in two positions and cooperate with said feet of said plate bars to select the latter;

a movable information storage which is moved by said carriages and an immovable storage arranged to supply information to said selectors so as to actuate the latter; and a disk having a side facing toward said plate bars and provided at said side with arresting formations arranged to arrest said plate bars upon their selection by said selection pieces and until their running over the needles.

* * * * *